US008091292B1

(12) United States Patent
Jalbert

(10) Patent No.: US 8,091,292 B1
(45) Date of Patent: Jan. 10, 2012

(54) LOW FORCE EGRESS AND SAFETY APPARATUS FOR SUBTERRANEAN WINDOW WELLS

(76) Inventor: Stephan J. Jalbert, Spokane, WA (US)

( * ) Notice: Subject to any disclaimer, the term of this patent is extended or adjusted under 35 U.S.C. 154(b) by 1427 days.

(21) Appl. No.: 11/522,015

(22) Filed: Sep. 15, 2006

(51) Int. Cl.
*E06B 3/30* (2006.01)

(52) U.S. Cl. ..... 52/107; 52/20; 49/54; 49/386

(58) Field of Classification Search ..... 52/19, 20, 52/107, 169.6; 49/50, 54, 131, 386; 404/4
See application file for complete search history.

(56) References Cited

U.S. PATENT DOCUMENTS 1,803,091 A * 4/1931 Bemis ..... 52/107
4,627,763 A * 12/1986 Roemer et al. ..... 49/131
5,271,195 A * 12/1993 Wahe ..... 52/107
5,507,590 A * 4/1996 Argandona ..... 52/20
7,444,784 B2 * 11/2008 Brown ..... 52/107

* cited by examiner

*Primary Examiner* — Basil Katcheves
*Assistant Examiner* — Matthew J Smith
(74) *Attorney, Agent, or Firm* — William A. Jeckle

(57) ABSTRACT

An apparatus for providing improved egress and greater safety for subterranean window wells. The apparatus has relatively low lifting force to allow people to escape fires and earthquake damaged buildings through egress windows. The apparatus can include mounts which are U-shaped and fit over opposing sides of the window well wall and are connected thereto. The mounts may have pivots which connect to an operator that applies upward force upon a grate assembly that covers the window well. The mounts and grate are hinged to pivot and allow the grate to be opened when needed. The operator has swivel and ball connections and an adjustable outboard connector.

1 Claim, 8 Drawing Sheets

LOW FORCE EGRESS AND SAFETY APPARATUS FOR SUBTERRANEAN WINDOW WELLS

TECHNICAL FIELD

The technical field of this invention is egress and safety apparatus for subterranean window wells.

BACKGROUND OF THE INVENTION

Both the law and practical safety considerations require or suggest that a person be able to exit a basement through a direct route to the outside. This is particularly important in times of emergency, such as during fires or even earthquakes. This is commonly accomplished via subterranean windows with removable sashes to provide an egress port. These are sometimes herein referred to as subterranean egress windows. These subterranean windows require adequate size to allow the passing of a human being. In many jurisdictions there are specific size requirements for egress windows to escape from the basement or similar partial or fully subterranean location.

In order to assure adequate space on the outside of the window, the area adjacent to the window is typically dug out and walled off. This is commonly done with preformed corrugated metal window well shells. Such window well shells help to sustain a window well which is an opening, void or space of adequate size to allow passage by a human from the basement or the structure.

Window well shells are commonly installed so as to have a rim extending several inches above ground level to help prevent water and debris from easily dropping into the well. This rim creates a tripping hazard which is unsafe. There has been a long-felt need to prevent people from inadvertently tumbling into such window wells and still not pose a hindrance to escape. The known prior approach has been to place a relatively heavy grate which merely rests upon the upper rim of the window well shell.

BRIEF DESCRIPTION OF THE DRAWINGS

Preferred forms, configurations, embodiments and/or diagrams relating to and helping to describe preferred versions of the inventions are explained and characterized herein, often with reference to the accompanying drawings. The drawings and all features shown therein also serve as part of the disclosure of the inventions of the current application. Such drawings are briefly described below.

DETAILED DESCRIPTION OF THE PREFERRED EMBODIMENTS

Introductory Note

The readers of this document should understand that the embodiments described herein may rely on terminology used in any section of this document and other terms readily apparent from the drawings and the language common therefor as may be known in a particular art and such as provided by dictionaries. Widely known are Webster's Third New International Dictionary, The Oxford English Dictionary (Second Edition), and The New Century Dictionary, all of which are hereby incorporated by reference for interpretation of terms used herein and for application and use of words defined in such references to more adequately or aptly describe various features, aspects and concepts shown or otherwise described herein using more appropriate words having meanings applicable to such features, aspects and concepts.

This document is premised upon using one or more terms with one embodiment that may also apply to other embodiments for similar structures, functions, features and aspects of the invention. Wording used in the claims is also descriptive of the invention and the text of both claims and abstract are incorporated by reference into the description entirely in the form as originally filed. Terminology used with one, some or all embodiments may be used for describing and defining the technology and exclusive rights associated therewith.

The readers of this document should further understand that the embodiments described herein may rely on terminology and features used in any section or embodiment shown in this document and other terms readily apparent from the drawings and language common therefor. This document is premised upon using one or more terms or features shown in one embodiment that may also apply to or be combined with other embodiments for similar structures, functions, features and aspects of the invention and provide additional embodiments of the inventions.

Basic or General Configuration

Figure 7:
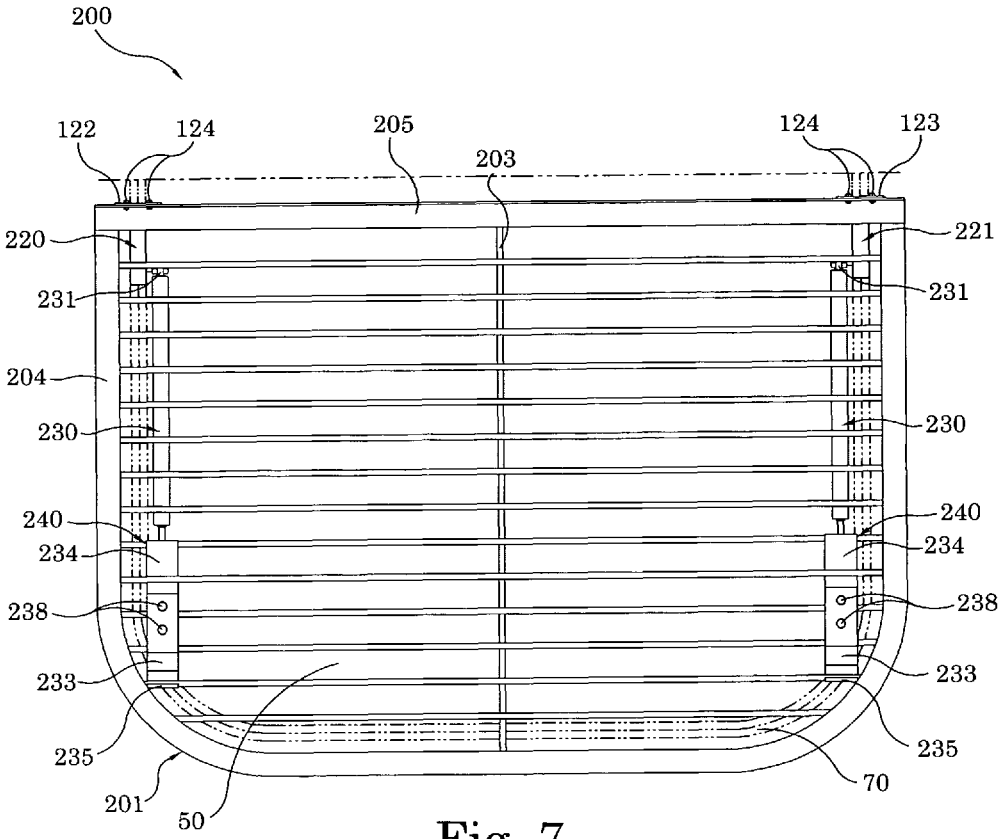
FIG. 7 is a top view of a second embodiment according to the inventions shown in a closed position.
Figure 8:
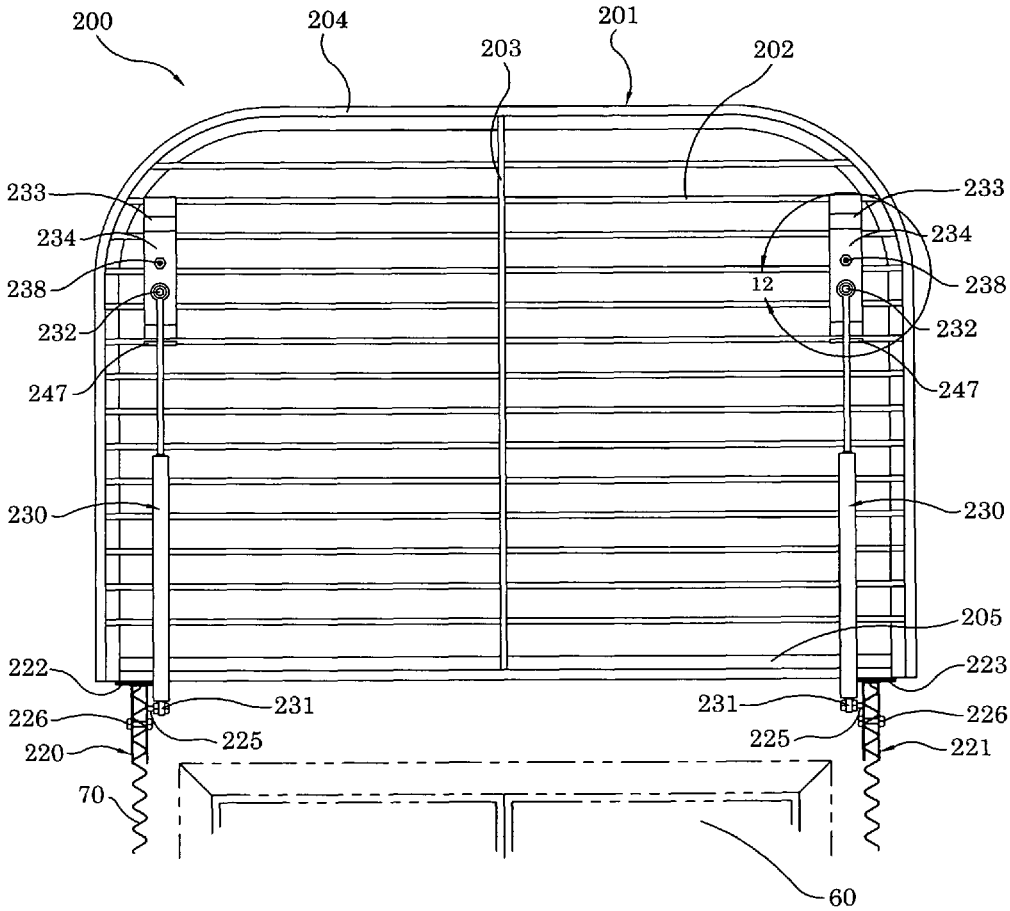
FIG. 8 is a front view of the embodiment of FIG. 7 in a open position.
Figure 9:
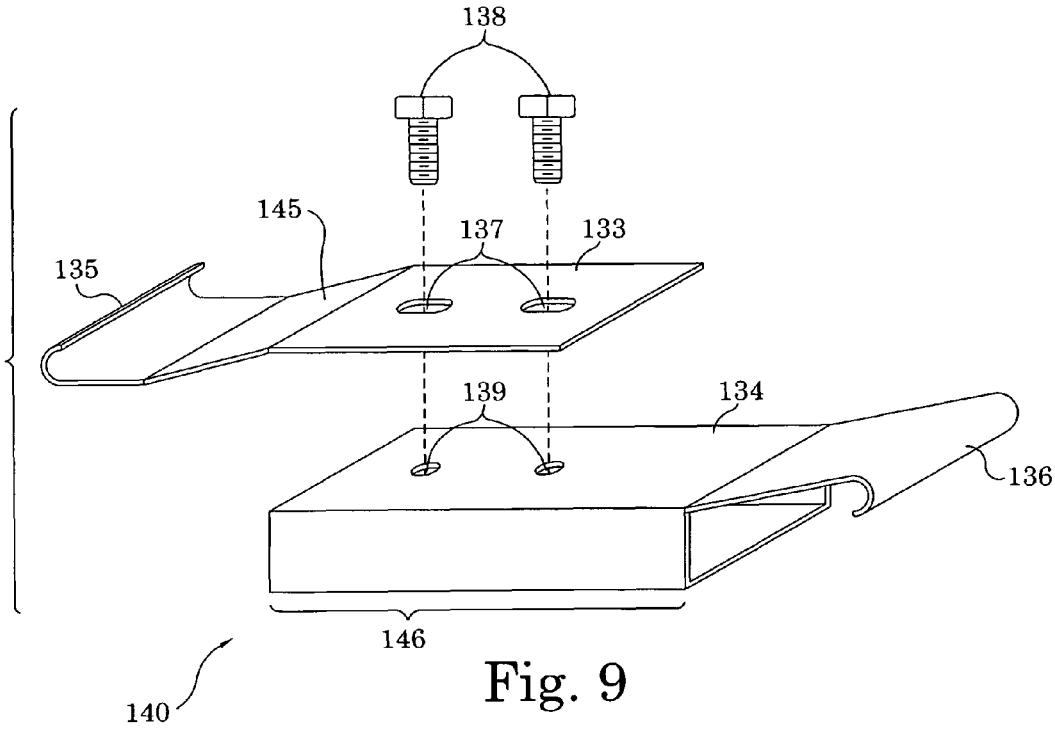
FIG. 9 is an enlarged exploded view showing a preferred form of outboard connector used to connect an operator to a preferred grate assembly.
Figure 10:
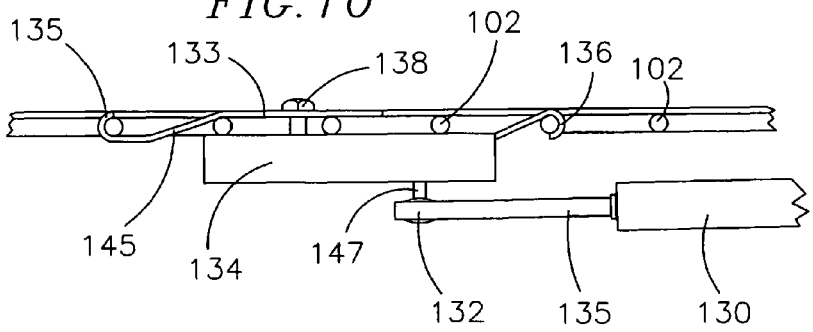
FIG. 10 is an enlarged view of the outboard connector and swivel and ball joint of FIG. 2.
Figure 11:
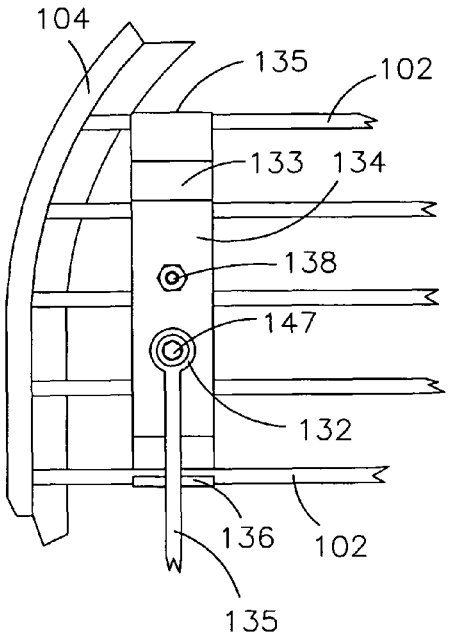
FIG. 11 is an enlarged view of the outboard connector and swivel and ball joint of FIG. 5.
Figure 12:
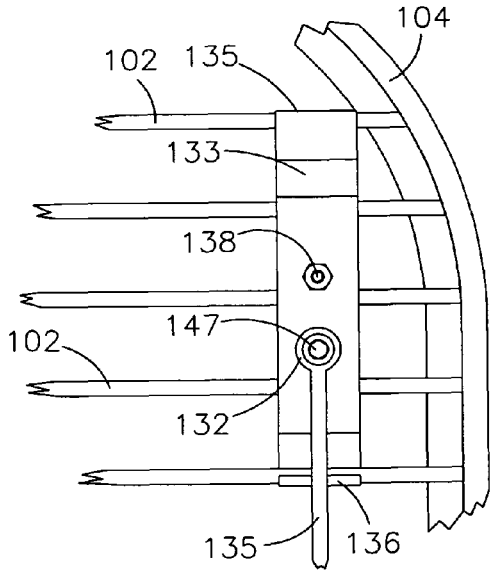
FIG. 12 is an enlarged view of the outboard connector and swivel and ball joint of FIG. 8.

Two embodiments are shown in FIGS. 1-8. FIG. 9 shows a detail common to both embodiments. The first embodiment, the currently preferred embodiment, is illustrated in the form of apparatus 100 as shown in FIGS. 1-6. A second embodiment is illustrated in the form of apparatus 200 as shown in FIGS. 7 and 8.

Similar items exist between the two embodiments and are thus labeled with similar reference numbers; the first embodiment uses a series of labeling while the second embodiment uses a 200 series. For example items 101 and 201 are similar for the respective first and second embodiments. This applies unless otherwise stated.

FIGS. 1-6 show a preferred egress and safety apparatus 100 for window wells according to the inventions. Apparatus or assembly 100 includes among other important features the basic parts which are a grate assembly 101, mounts 120 and 121 for attaching the grate to a window well shell or more simply called a window well 70, and an operator 130.

Figure 2:
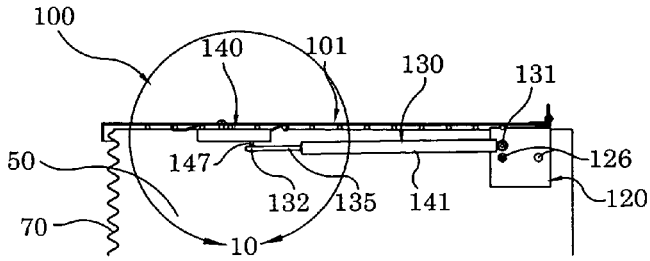
FIG. 2 is a cross-sectional view of the embodiment of FIG. 1 in a closed position taken along line 2-2 of FIG. 1.
Figure 3:
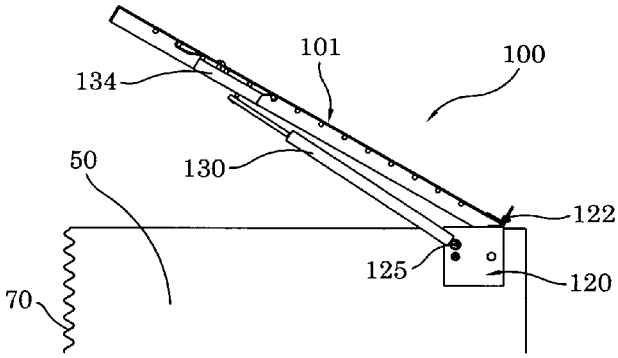
FIG. 3 is a cross-sectional view of the embodiment of FIG. 1 in a intermediate position taken along line 2-2 of FIG. 1.

A preferred form of operator 130 is a sealed piston compressed gas charged spring which applies an upward biasing force tending to open the outboard or front portion of the grate assembly 101, as will be further explained below. The operator has inboard and outboard connectors 131 and 132, respectively, (FIG. 2). The connectors 131 and 132 are different and are specially configured for attaching the operator to mount 120 and grate assembly 101, respectively, as will be detailed below.

Figure 1:
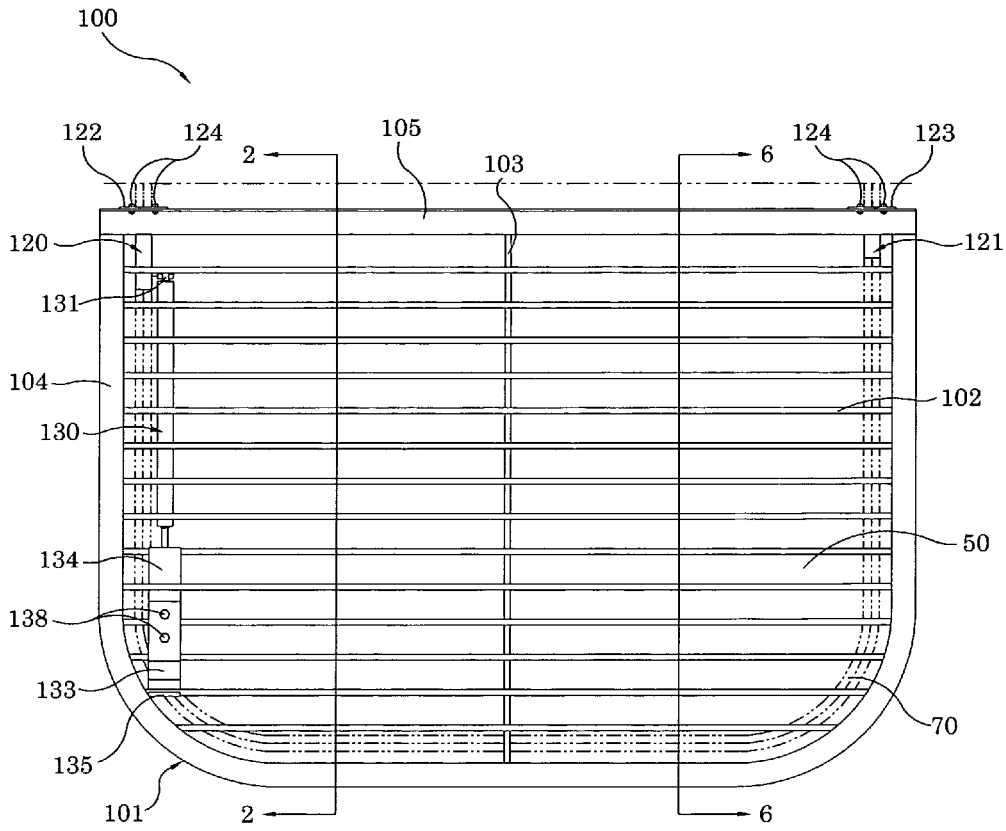
FIG. 1 is a top view of a preferred embodiment according to the inventions hereof shown in a closed position.

The rear of the grate assembly is attached to hinges 122 and 123. These hinges are secured to mounts 120 and 121 in a suitable manner, such as by fasteners 124 (FIG. 1). Hinges 122 and 123 allow the grate to pivot when sufficient upward forces are applied. The mounts are bolted to the window well shell 70 and allow the assembly 101 to be adjustably anchored upon the shell 70 at a suitable position spaced from a structure to provide clearance as needed for proper operation and pivotal movement of the grate. On mount 120 is an stud 125. Stud 125 secures the lower or inboard end of the operator 130. The upper or outboard end of the operator is attached to the grate via a outboard operator connector. The operator 130 aids in lifting the outboard or front of the grate pivoting the assembly 101 toward an open position. The operator 130 allows the grate assembly to be opened with a small amount of upward force, for example 5-10 pounds, so that even a child, older person or other less capable person may escape from the window well 50.

Egress Window, Window Well and Well Shell

Figure 4:
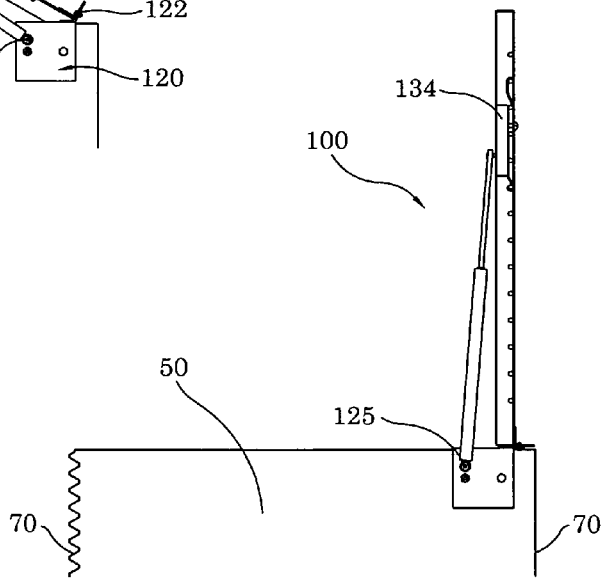
FIG. 4 is a cross-sectional view of the embodiment of FIG. 1 in a open position taken along line 2-2 of FIG. 1.
Figure 5:
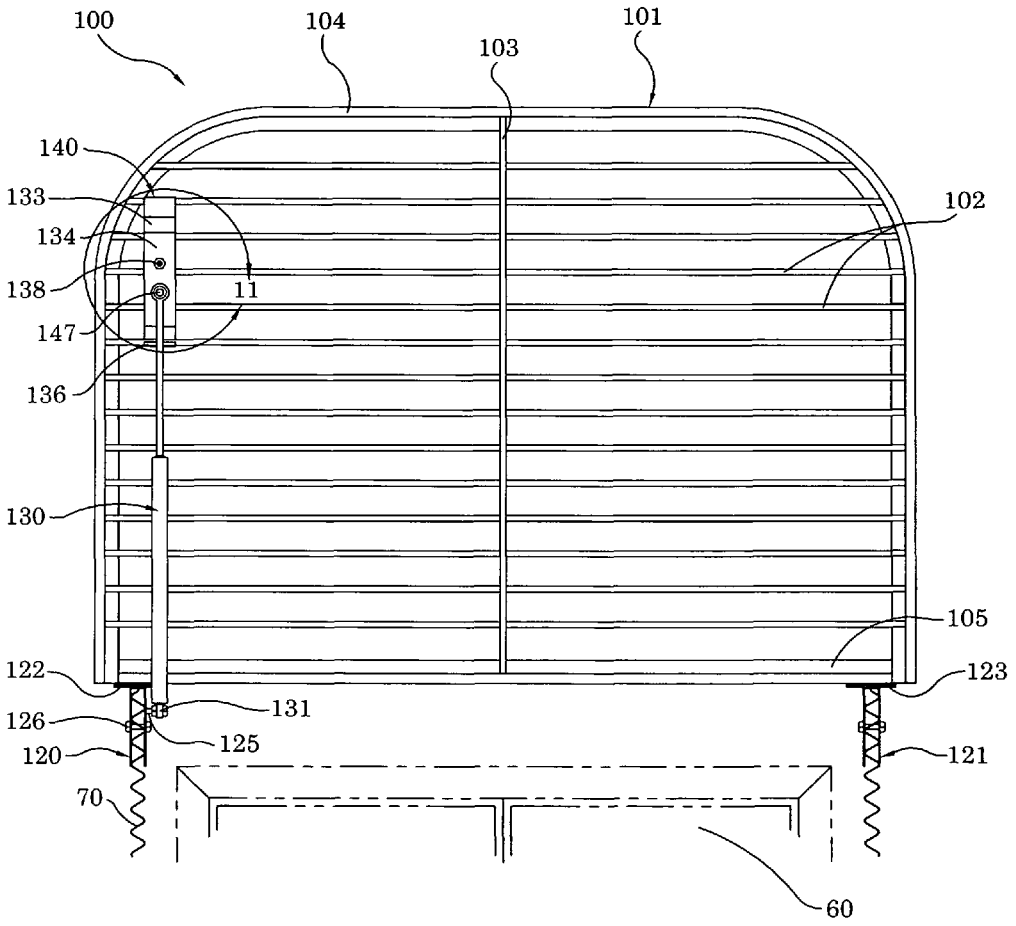
FIG. 5 is a front view of the embodiment of FIG. 1 in a open position.
Figure 6:
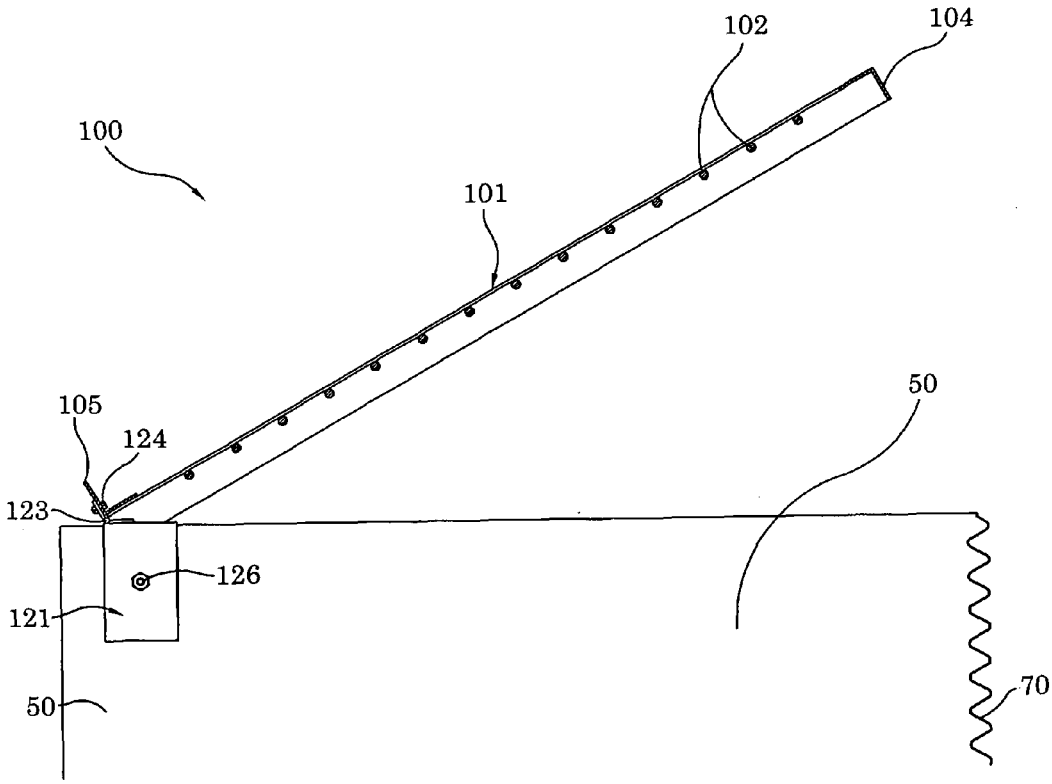
FIG. 6 is a cross-sectional view of the embodiment of FIG. 1 in a intermediate position taken along line 6-6 of FIG. 1.

FIGS. 4 and 5 show the window well 50 as the open space adjacent to the egress window 60 shown in phantom in FIG. 5. This well space is necessary for the movement of a person through the egress window. The window well 50 is surrounded and maintained by the window well shell 70. The egress window and well shell 70 are properly sized for escape. As a person climbs through the egress window the grate assembly 101 is pivoted open with the lifting assistance of the operator 130. This is important because the escaping person is in an awkward position. For people of weak condition it is even more important to allow quick escape, such as from a burning building.

Grate Assembly

Grate assembly 101 can be made in different configurations and of various suitable materials. As shown, the preferred grate assembly includes an array of grate members which preferably extend approximately fully across the grate. This provides improved strength. The grate advantageously includes lateral cross members 102 and one or more intersecting members, such as medial intersecting member 103. The intersecting member 103 as shown is transverse to the cross members, and more particularly is approximately perpendicular thereto. The grate may be constructed with the intersecting member or members advantageously positioned below crossbars 102. Cross member 103 provides increased rigidity and load bearing capabilities. The crossbars and intersecting member may advantageously be made of reinforcing steel provided with ridges which aid in traction should a person have need to stand upon the grate.

The grate assembly 101 also preferably includes an L-shaped front or outboard perimeter piece 104. Perimeter piece 104 is configured to complement the shape of the window well shell. The back of the grate assembly includes back perimeter piece 105. Perimeter pieces 104 and 105 are joined together, such as by welding to form an integrated grate perimeter frame. As shown, the back perimeter piece 105 has an upstanding leg of the L-shaped or angle shaped piece.

The perimeter frame has crossbars 102 and intersecting member 103 connected. This is advantageously done in steel and the crossbars and intersecting member 103 are attached thereto by welding. The front perimeter piece has the cross members 102 attached thereto. The intersecting member 103 is attached to the front perimeter piece at the front and to the back perimeter piece at the back.

The back perimeter piece 105 preferably serves as the mounting piece for hinges 122 and 123 to the grate frame. Bolts 124 are used to detachably secure the hinges to the grate frame. The grate is thus capable of pivoting on the hinges rotating upward into an open position and back down into a closed position.

Mounts

Mounts 120 and 121 secure the grate assembly to the window well. Hinges 122 and 123 are attached to mounts 120 and 121, respectively. This is advantageously done by welding the hinges so as to cause rigid attachment to the mounts to form a mounting assembly which includes the hinges and mounts. The grate assembly 101 thus can be detachably fastened to the mounting assemblies using fasteners 124.

The mounts are advantageously approximately U-shaped, more properly a channel shape, to sit securely over the rim of the window well shell and extend down each side of the shell.

The left operator mount 120 is constructed differently than mount 121 because mount 120 is adapted for connection to not only the window well shell 70, but also the operator 130. Operator 130 has an inboard end fitting 131 which acts to connect the operator 130 onto an inwardly extending stud 125 (FIG. 4). Stud 125 may extend through the mount and shell 70 or be attached to the inside leg of the mount 120.

FIG. 2 shows that mount 120 includes shell fasteners 126 which have associated mount apertures. The outboard fastener is preferably provided with a small clearance toward operator 130, such as by making the bolt head inside. The inboard fastener can be turned in the opposite direction.

The right mount 121 can be simplified by having only a single fastener 126. Alternatively, the mounts can be similar in their mounting aperture and bolt configuration.

Operator

Operator 130 provides additional force for pivoting the grate assembly from a closed position FIG. 2 through intermediate positions (for example FIG. 3) to an open position (FIG. 4). Operator 130 as shown includes a cylinder portion 141 which has a connector, preferably in the form of a pivotal end 131 which mounts on operator mount 125.

Operator 130 also has a rod portion 135 which is connected to a sealed piston which is internal and not shown. The side of the piston (not shown) that is toward inboard end 131 is charged with a suitable compressed gas. The compressed gas is charged up to a pressure desired to provide sufficient force to reduce the lifting required by a person to be relatively light, such as 5-10 pounds of force to lift the grate assembly when in the closed position.

Outboard Operator Connector

FIG. 9 shows a preferred outboard operator connector assembly 140. Connector assembly 140 has a first piece 133 and a second piece 134. First piece 133 has a hook end which when stalled as shown is to the outboard end and hooks over a crossbar 102. First piece 133 also has slotted apertures 137 which receive fasteners 138 therethrough. This construction allows installation and adjustment of the first piece relative to the second piece to accommodate placement and adjustment to the spacing between crossbars 102.

First piece 133 also has a sloped region or offset 145 which is approximately equal to the diameter of the crossbars.

Second piece 134 is designed to distribute the load of the operator upon a plurality of crossbars 102. In a current preferred version the second piece distributes using the main piece 146 over three crossbars. Less or more length is possible, but it is preferred to bear upon at least two crossbars with the main piece 146.

As shown, main piece 146 is a piece with a rectangular cross sectional shape. Main piece 146 is advantageously tubular to reduce materials requirements.

Main piece 146 also has a pair of mounting apertures 139 through which fasteners 138 extend. The apertures 139 can either be plain or threaded. If plain then a corresponding nut (not shown) would be installed either in the interior or after the bolts 138 pass through the main piece 146.

Main piece 146 is also provided with a hook extension 136 which is preferably angled to provide an offset to position the hook for engagement with the crossbars.

Further main piece 146 has a stud 147 (FIG. 2) which forms a connector part upon which the outboard end fitting 132 of the operator is connected. The outboard end fitting preferably has a spherical or ball mounting so that the changing angle of the operator relative to the stud can be accommodated.

Second Embodiment

The second embodiment is similar to the first embodiment only there are operators 230 at each side to help accommodate a greater weight or provide more balanced operation or both. To accomplish this the mounts 220 and 221 are made as mirror images and a second operator 230 is used. There is also an outboard connector assembly 240 at both operators constructed similar to outboard connector 140.

More about Preferred Manners of Making the Preferred Inventions

The apparatuses according to the inventions shown and described herein can be made from a variety of suitable materials. A preferred material of construction is steel. Other metals or even plastics may be suitable.

When steel and other materials are used a preferred manner of making is by fabrication using welding of components, except as indicated above where fasteners are desired. The apparatus could also be molded if the quantity justifies the making of molds. This may be more preferred with some materials than with other materials.

Further Aspects and Features

The above description has set out various features and aspects of the invention and the preferred embodiments thereof. Such aspects and features may further be defined according to the following claims which may individually or in various combinations help to define the invention.

Interpretation Note

The inventions shown and described herein have been described in language directed to the current preferred embodiments. Also shown and described with regard to various structural and methodological features. The scope of protection as defined by the claims is not intended to be necessarily limited to the specific sizes, shapes, features or other aspects of the preferred embodiments shown and described. The claimed inventions may be implemented or embodied in other forms while still including the concepts shown and described herein. Also included are equivalents of the inventions which can be made without departing from the scope of concepts properly protected hereby.

I claim:

1. An apparatus for controllably covering and opening a window well which is at least partially subterranean, comprising:

at least one mount adapted for attachment to the window well wherein the at least one mount includes at least two U-shaped mounting pieces which fit over an upper edge of the window well along opposing sides of the window well;

at least one grate pivotally connected to said at least one mount, said at least one grate having a grate frame and plural grate elements arranged in spaced relationship;

at least one operator inboard mounting feature on said at least one mount;

at least one operator, said operator having an inboard end and an outboard end;

at least one operator inboard connector for detachably connecting the at least one operator toward the inboard end thereof to said at least one operator inboard mounting feature wherein the at least one operator inboard connector is configured to provide a swivel and ball joint;

at least one operator outboard connector for detachably connecting the at least one operator toward the outboard end thereof to the at least one grate wherein the at least one operator outboard connector provides a ball joint and an elongate member which extends over a plurality of grate elements;

wherein said operator applies force to assist in opening said at least one grate relative to the window well to reduce opening force required to open the at least one grate to allow egress from the window well.

* * * * *